US005280137A

United States Patent [19]

Ward

[11] Patent Number: 5,280,137

[45] Date of Patent: Jan. 18, 1994

[54] MATTE FINISHED CABLE JACKET

[75] Inventor: Robert E. Ward, Richmond, Ind.

[73] Assignee: Cooper Industries, Inc., Houston, Tex.

[21] Appl. No.: 874,820

[22] Filed: Apr. 28, 1992

[51] Int. Cl.[5] ..... H01B 7/02

[52] U.S. Cl. ..... 174/120 SR; 174/110 V; 174/113 R; 174/116; 385/112

[58] Field of Search ..... 174/120 R, 120.5 R, 113 R, 116, 110; 385/101, 109, 385/112

[56] References Cited

U.S. PATENT DOCUMENTS 3,479,446 11/1969 Arnaudin, Jr. et al. ..... 174/120 R
3,602,636 8/1971 Evans ..... 174/115
3,769,085 10/1973 Matsubara ..... 174/120 SR
3,843,831 10/1974 Hutchison et al. ..... 174/116
4,430,385 2/1984 Dillow et al. ..... 174/120 SR
4,707,569 11/1987 Yoshimura et al. ..... 174/116
4,847,151 7/1989 Ichiro ..... 174/120 SR
4,910,359 3/1990 Dougherty et al. ..... 174/120 SR

*Primary Examiner*—Morris H. Nimmo
*Attorney, Agent, or Firm*—Laff, Whitesel, Conte & Saret

[57] ABSTRACT

A thermoplastic cable and method of manufacture for use in an electrical system comprising a core which comprises a transmission medium, said transmission medium being an insulated metallic conductor or optical fiber, and a jacket which encloses the core and the jacket being co-extruded on the core and comprises an extruded inner layer and an extruded outer layer, with the inner layer being inseparable from and integrally formed with the outer layer.

8 Claims, 1 Drawing Sheet

MATTE FINISHED CABLE JACKET

FIELD OF THE INVENTION

This invention relates to cable jackets. More particularly, this invention relates to thermoplastic cable jackets having inseparable and integrally formed layers of extruded materials which are suitable for both indoor and outdoor use.

BACKGROUND OF THE INVENTION

Outdoor cables or cords are generally manufactured with a glossy jacket finish. However, due to a common user perception, such a finish is synonymous with low cost electrical and electronic products. Matte finishes, on the other hand, have a user perception of being synonymous with quality electrical and electronic products. These matte jacketed cables are typically used indoors as, for example, power supply cords. While these matte jacketed cables conform to consumer demands on appearance and are suitable for indoor use, they do not satisfy the minimum sunlight resistance and low temperature performance while maintaining tensile and elongation requirements of standards organizations, such as Underwriters Laboratories, Inc. (UL) or Canadian Standards Association (CSA), which are necessary for the outdoor usage of cables. Thus, current techniques and materials produce cables that exhibit either a glossy (high luster) appearance or a matte finish that fails to meet the necessary UL and CSA requirements for both indoor and outdoor use.

SUMMARY OF THE INVENTION

Accordingly, it is an object of the present invention to provide a novel thermoplastic cable and method of manufacture that exhibits a low luster or matte finish appearance and which is suitable for indoor and outdoor use.

It is another object of the present invention to provide a thermoplastic cable and method of manufacture that meets approval of all relevant standards organizations for indoor and outdoor use.

It is a further object of the present invention to provide a thermoplastic cable and method of manufacture that is sheathed with inseparable layers of either dissimilar or similar materials and/or colors.

It is yet another object of the present invention to provide a thermoplastic cable and method of manufacture that has lower production costs due to reduced waste.

The objectives and advantages of the present invention are achieved, in a preferred embodiment, by providing a thermoplastic cable for use in an electrical system and method of manufacture that involves in most instances forming two individual layers (outer and inner layers) of extruded material into one inseparable and integrally formed layer. The inner layer includes an equal but preferably higher tensile strength compound than the outer layer. Moreover, the inner and outer layers may comprise the same or different materials or colors.

The inner layer and outer layer are adhered together by a co extrusion technique wherein the outputs of two separate extruded melt streams or layers are fed simultaneously into one set of forming dies. This results in one layer (a smoothing or finishing layer) of extruded material being superimposed onto the other (a base or supporting layer). Since the materials in the two layers exhibit similar properties, bonding occurs between the layers and the result is one inseparable extruded part.

Coextrusion may be accomplished by any one of a number of processes, including a process wherein the layers flow completely separately. This particular process involves an extrusion process wherein the layers flow in individual, completely separate flow channels through two separate extruder barrels to form two separate polymer streams. During this process, the polymer may be melted, sheared, rubbed, or kneaded within the extruder barrel to obtain a homogeneous melt.

Subsequent to the extrusion process, the two layers are forced through and discharged from a common die as polymer melt. Polymer melt layers are then brought together by a forming die to form a single, inseparable, integrally formed layer.

An advantage of the coextrusion process is that two layers with different flow characteristics (viscosities) can be processed at different temperatures. Furthermore, the pressure in the separate layer channels may also be different.

Thus, the aforementioned coextrusion process allows for the production of matte finished polyvinylchloride cables with two nonseparable layers, wherein the inner layer conforms to minimum tensile and elongation requirements of the UL and CSA standards organizations for indoor and outdoor usage and the outer layer satisfies consumer demand for a specific appearance while meeting the required sunlight resistance and low temperature properties.

DETAILED DESCRIPTION OF THE INVENTION

Figure 1:
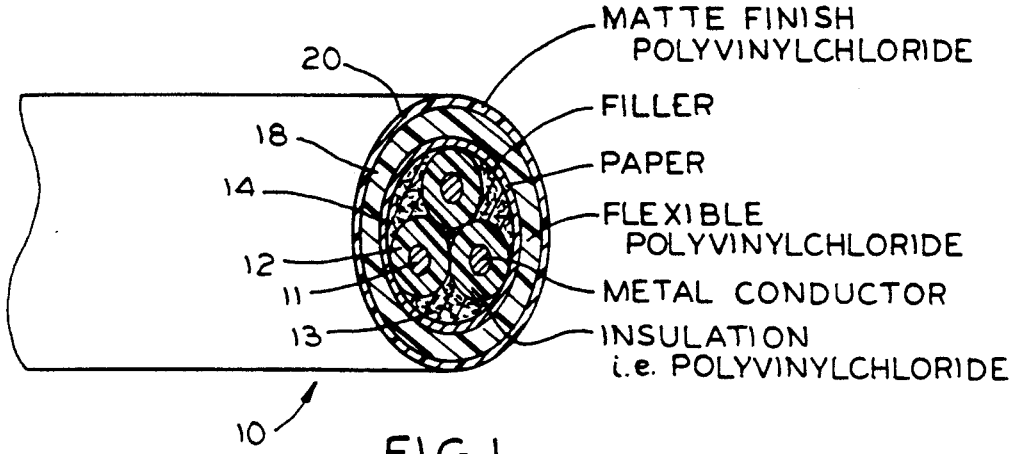
FIG. 1 is a perspective view of the inventive coextruded, matte-finished polyvinylchloride cable.
Figure 2:
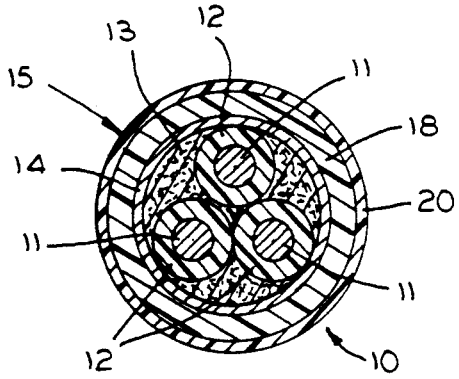
FIG. 2 is a cross-sectional view of the cable of FIG. 1.

Referring to FIGS. 1 and 2, the invention provides a thermoplastic cable, generally denoted by the numeral 10, and method of manufacture therefore, for use in electrical systems. Cable 10 has a plurality of conductors 11 which generally have an insulation 12 thereon. The conductors are generally copper in the size range of 10 to 18 AWG and the insulation is preferably an appropriate polyvinylchloride which is appropriate for the 10 to 18 AWG size range and which may be oil resistant.

Surrounding the insulated conductors is filler 13. Filler material 13 is preferably an appropriate textile that surrounds and fills the spaces between the conductors. Preferred fillers are polypropylene fibers, jute, cotton and polyamide fibers, i.e. Kevlar.

Filler 13 is often surrounded by an appropriate paper or fabric separator 14 which is wrapped around the cabled fillers and insulated conductors to provide a non-jacketed cable that is substantially cylindrical. The separator may be applied to the cable during the extrusion process.

The non-jacketed cable is subsequently provided with a longitudinally extending jacket or sheath 15 which envelopes or surrounds the non-jacketed cable.

Jacket 15 includes an annular longitudinally circumferentially extending inner layer 18 and an annular longitudinally extending outer layer 20.

The inner layer 18 is the base material of the jacket and outer layer 20 is the finished appearance material on the exterior of the jacket. The inner layer 18 is preferably a flexible thermoplastic polyvinylchloride which may be oil resistant at a temperature of from about 60° C. to about 105° C. with about a 0.030 inch thickness and which has a 300 volt rating. Moreover, inner layer 18 is of a polyvinychloride material rated for indoor or outdoor use by standards organizations such as Underwriter's Laboratories.

The outer layer 20 is preferably a flexible thermoplastic matte type polyvinylchloride which is generally rated for outdoor use but may be rated for indoor use as well. Outer layer 20 may be oil resistant at a temperature of at least about 60° C. with about a 0.005–0.008 inch thickness, in conjunction with the inner layer, carries a 300 volt rating.

Layers 18 and 20 may comprise the same or different materials and may be the same or different colors. Regardless of the materials used in the two layers, the overall jacket construction comprises inseparable layers of two integrally formed materials.

The thickness of the insulation and jacket generally depend on the size of the cable. However, the conductor insulation 12 is typically from about 0.015 inches to about 0.075 inches thick, the base jacket 18 is from about 0.020 to about 0.065 inches thick, and the matte finished skin 20 being from about 0.005 to about 0.008 inches thick. The preferred jacket 15 has an outer matte finish and the jacket 15 has overall temperature rating of from about 60° C. to about 105° C. and a voltage rating of 300 volts.

Figure 4:
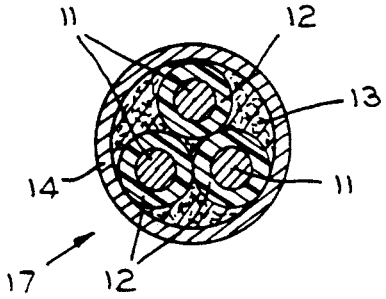
FIG. 4 is an enlarged cross-section taken along lines 4—4 of FIG. 3.

The non-jacketed cable 17 (FIG. 4) is jacketed by a co-extrusion process. Conventionally, the non-jacketed cable 17 is jacketed by extruding thereon a single jacket of the outdoor rated polyvinylchloride 18 or a single jacket of the indoor rated matte finish polyvinylchloride 20. The present invention provides an improved cable by co-extruding onto a non-jacketed cable a first base of indoor or outdoor rated flexible polyvinylchloride and a second outer skin of outdoor rated matte finish type flexible polyvinylchloride.

Figure 3:
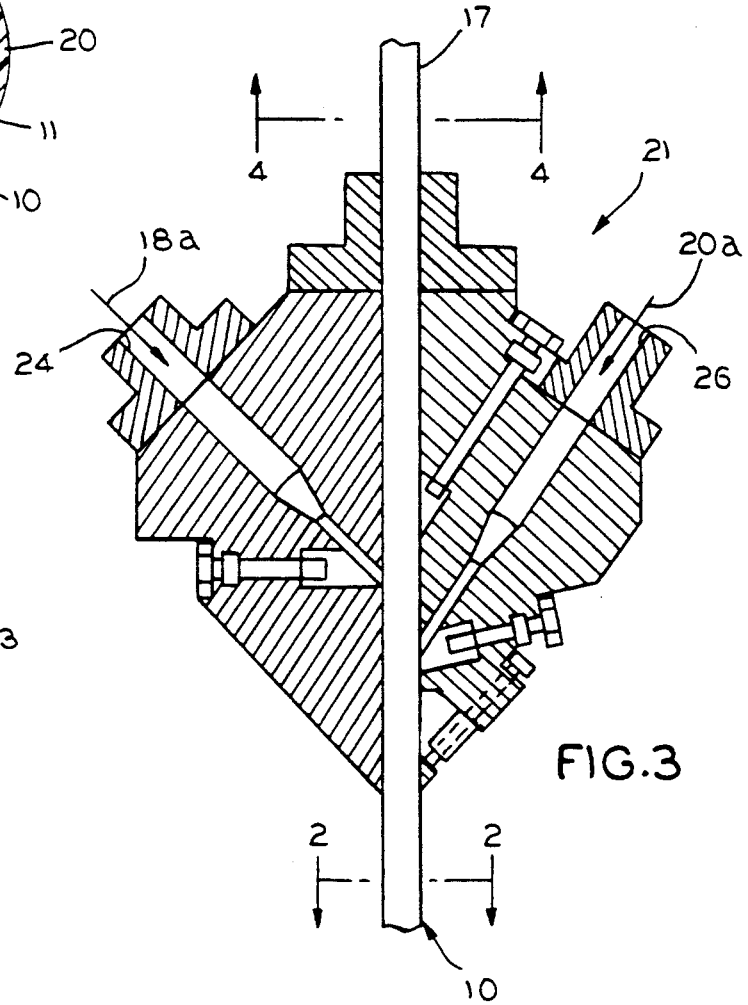
FIG. 3 is a side view of a conventional coextrusion die used to produce the cable of FIG. 1.

A conventional coextrusion die 21 is illustrated in FIG. 3 wherein a first polyvinylchloride composition melt stream and a second polyvinylchloride composition melt streams are fed from two separate extruders (not shown) which prepares the appropriate first 18*a* and second 20*a* polyvinyl chloride composition melts, as described below.

The first melt composition 18*a* is a polyvinylchloride composition generally acceptable for an outdoor rated cable jacket wherein the polyvinylchloride is flexible, may have oil resistant properties and a temperature rating of at least about 60° C. and preferably up to about 105° C. when having a 0.030 inch thickness and a voltage rating of 300 volts. The first polyvinylchloride composition generally has a glossy finish. The first polyvinylchloride composition also has a higher tensile strength than the second polyvinylchloride composition.

The second melt 20*a* is a polyvinylchloride composition generally acceptable for an outdoor rated cable jacket. The second polyvinylchloride composition is flexible, may have oil resistant properties and a temperature rating of less than about 105° C. and preferably about 60° C. when having a 0.005–0.008 inch thickness. The second polyvinylchloride composition generally would have a matte finish and a tensile strength which is less than the tensile strength of the first polyvinylchloride composition.

Referring to FIG. 3, a non-jacketed cable 17 is fed into the coextrusion die 21. The non-jacketed cable 17 (see FIG. 4) has a plurality of conductors 11 having insulation 12 thereon. The conductors are generally of the size range 10 to 18 AWG and are preferably of copper. Surrounding the insulated conductors is a filler 13. The filler, as noted above, is preferably a textile filler that surrounds and fills the spaces around the insulated conductors. Surrounding the filler and insulated conductors is an appropriate paper or fabric separator 14.

The non-jacketed cable 17 generally passes through the center of the coextrusion die 21. A first polyvinylchloride composition 18*a* (shown schematically) is fed to the die 21 via inlet 24. The inlet 24 feeds into a cylindrical extruder die mouth to extrude a first cylindrical polyvinylchloride composition onto the separator 14 of the non-jacketed cable 17. A second polyvinylchloride melt 20*a* (shown schematically) is fed into the coextrusion die via extruder inlet 26 which feeds into the cylindrical extruder mouth to extrude a second cylindrical layer of the second composition onto the first cylindrical layer. Since both the first and second compositions contain a compatible composition they adhere to each other without the necessity of a separate binder or adhesive.

The first polyvinyl extruder die mouth is set to extrude the first cylindrical layer on the separator 14 having a thickness of from about 0.020 to about 0.065 inches and preferably from about 0.020 to about 0.050 inches. The second die mouth is sized and positioned to extrude the second cylindrical layer on the first cylindrical layer. The second cylindrical layer has a thickness of from about 0.005 to about 0.008 inches.

The cable leaving the extruder is cable 10 which is delivered to appropriate cooling zones to solidify the first and second polyvinyl chloride layers.

The foregoing description is for purposes of illustration, rather than limitation of the scope of protection accorded this invention. The latter is to be measured by the following claims, which should be interpreted as broadly as the invention permits.

I claim:

1. A cable for use in an indoor and outdoor electrical system comprising:

a core which comprises a transmission medium, said transmission medium being an insulated metallic or optical fiber conductor;

a thermoplastic jacket which encloses said core and transmission medium, said jacket having an inner layer and an outer layer, said inner layer being inseparable from and integrally formed with said outer layer, said inner layer and said outer layer having as their main ingredient the same thermoplastic material, and said inner layer having a higher tensile strength compound than said outer layer.

2. The cable of claim 1 wherein said inner layer and outer layer are co-extruded onto a non-jacketed cable.

3. The cable of claim 1 wherein said inner layer is an indoor or an outdoor rated plastic material and said outer layer is an outdoor rated plastic material.

4. The cable of claim 1 wherein said inner layer is an indoor or outdoor rated flexible polyvinylchloride having a temperature rating of at least about 60° C. at a 0.030 inch thickness and a voltage rating of 300 volts.

5. The cable of claim 1 wherein said outer layer is a flexible matte finish type polyvinylchloride with a temperature rating of less than about 105° C. and a thickness range of about 0.005 inches to about 0.008 inches and, in conjunction with the inner layer, a voltage rating of 300 volts.

6. A cable for use in an indoor and outdoor electrical system comprising:

a core which comprises a transmission medium, said transmission medium being an insulated metallic or optical fiber conductor;

a thermoplastic jacket which encloses said core and transmission medium, said jacket having an inner layer and an outer layer, said inner layer being inseparable from and integrally formed with said outer layer, said inner layer being an indoor or an outdoor rated flexible polyvinylchloride having a temperature rating of at least about 60° C. at a 0.030 inch thickness and a voltage rating of 300 volts, and said inner layer being from about 0.020 inches to about 0.065 inches thick and said outer layer being from about 0.005 to about 0.008 inches thick.

7. The cable of claim 6 wherein said inner layer and outer layer have as their main ingredient the same plastic material.

8. A thermoplastic cable for use in an indoor and outdoor electrical system comprising:

a core which comprises an insulated transmission medium, said transmission medium having at least two metallic conductors or optical fibers each coated with insulating polyvinylchloride;

a filler surrounding said transmission medium, said filler being selected from polyamide fibers, jute fibers, cotton fibers or polypropylene fibers;

a separating layer wrapped around said filler and insulated conductors; and a flexible multi-layer polyvinylchloride jacket which encloses said core, said jacket having an inner layer and an outer layer, said inner and outer layer co-extruded onto said core and subsequently fed into a single set of forming dies such that they are inseparable from and integrally formed with one another, said inner layer being a flexible polyvinylchloride composition having a thickness of at least 0.025 inches and an indoor and outdoor electrical rating with temperature rating of at least about 60° C. when having a 0.030 inch thickness and a voltage rating of 300 volts, said outer layer being a flexible polyvinylchloride composition with a matte type finish and a thickness of at least 0.005 inches and a temperature rating of less than 105° C., and said inner layer having an equal or higher tensile strength than said outer layer.

* * * * *